US006155215A

United States Patent [19]

Muth

[11] Patent Number: 6,155,215

[45] **Date of Patent: *Dec. 5, 2000**

[54] ROTARY VALVE INTERNAL COMBUSTION ENGINE

[76] Inventor: Barry A. Muth, 129-C Farrington Rd., Raleigh, N.C. 27615

[ * ] Notice: This patent is subject to a terminal disclaimer.

[21] Appl. No.: 09/106,404

[22] Filed: Jun. 29, 1998

Related U.S. Application Data

[63] Continuation-in-part of application No. 08/714,591, Sep. 16, 1996, Pat. No. 5,816,203, which is a continuation-in-part of application No. 08/387,182, Feb. 13, 1995, Pat. No. 5,579,734.

[51] Int. Cl.[7] ..... F01L 7/06

[52] U.S. Cl. ..... 123/80 BB; 123/80 D; 123/190.5; 123/190.15

[58] Field of Search ..... 123/190.1, 190.4, 123/190.5, 190.8, 190.14, 190.15, 190.17, 190.9, 80 BB, 80 D, 668, 80 R; 60/302, 304

[56] References Cited

U.S. PATENT DOCUMENTS

| | | | |
|---|---|---|---|
| Re. 25,787 | 6/1965 | Gary | 60/304 |
| 4,279,225 | 7/1981 | Kersten | 123/80 BB |
| 5,579,734 | 12/1996 | Muth | 123/296 |
| 5,816,203 | 10/1998 | Muth | 123/80 BB |

*Primary Examiner*—Andrew M. Dolinar
*Assistant Examiner*—Hai Huynh
*Attorney, Agent, or Firm*—Coats & Bennett, P.L.L.C.

[57] ABSTRACT

An internal combustion engine includes an engine block having one or more cylinders and a rotary disk valve mounted on top of the engine block. The rotary disk valve includes an intake passage for directing intake air into the cylinders and an exhaust passage for exhausting combustion gases from the cylinder. The center of the intake passage and exhaust passage are equidistant from the axis of rotation of the rotary valve. The intake passage and exhaust passage in the rotary valve communicate with each cylinder in succession as the valve rotates, allowing the use of a single valve to serve multiple cylinders. Both the intake passage and exhaust passage have a cross sectional area at its narrowest point equal to at least 40% of the cross sectional area of the cylinders.

7 Claims, 7 Drawing Sheets

ROTARY VALVE INTERNAL COMBUSTION ENGINE

This application is a continuation-in-part of U.S. patent application Ser. No. 08/714,591 filed Sep. 16, 1996 which issued on Oct. 6, 1998 as U.S. Pat. No. 5,816,203; which is a continuation-in-part of U.S. application Ser. No. 08/387,182 filed Feb. 13, 1995 which issued as U.S. Pat. No. 5,579,734.

FIELD OF THE INVENTION

The present invention relates generally to internal combustion engines, and more particularly, to an internal combustion engine utilizing a rotary valve for directing the flow of intake air into the cylinders and exhausting gases from the cylinders.

BACKGROUND OF THE INVENTION

Increasing concerns about the impact of the internal combustion engine on global warming are putting added pressures on the automotive industry to develop more environmentally friendly engines. Generally, the approach is to increase the efficiency of the engine while reducing the displacement in efforts to bum less fuel thereby reducing emissions. This small displacement engine would be used as a stand alone power plant or as the principal source of power in an electric hybrid configuration. Currently, the most promising candidate is to take the most efficient internal combustion engine, the direct-injection (DI) diesel, and reduce its' displacement to as small as operationally possible. Due to minimal power requirements demanded by consumers, the required displacement to produce acceptable output with present technology will be at least 1.0 liters.

Four major concerns are associated with the use of diesel technology in the personal-use vehicle market. First, consumer acceptance of diesels has been mitigated by the noise, vibration and harshness (NVH) associated with diesel operation. Second, the power to weight ratio tends to decrease with decreasing displacement. The latter difficulty is due to the lack of direct proportionate component reduction in size or weight as displacement is reduced. Examples of this are the inability to reduce components such as cast wall thickness, injection systems, superchargers, etc. at the same scale as the displacement. Third, compounding this problem is the related difficulty of maintaining the same air transporting capacity as with larger displacements due the inability to proportionally scale components such as valve stems, injectors and glow plugs. Finally, reducing cylinder displacements reduces thermal efficiency due to reduced combustion chamber surface-to-volume ratio.

While the rotary valve engine in my co-pending application Ser. No. 08/714,591 (which is incorporated herein by reference) can use various fuels, it is particularly well suited for small cylinder diesel operation. This Rotary Valve Diesel (RVD) addresses the principal concerns listed above. With respect to the preferred embodiment of four cylinders, the RVD uses short, twin, opposed revolution, lightweight crankshafts with crank throws located 180 degrees apart from the adjacent crankthrow. This arrangement with other elements described later, greatly reduces the NVH of this engine. Second, the compact size of the engine along with the lightweight cranks reduce the weight of the RVD. Third, the size of the intake and exhaust valve openings, as well as the intake and exhaust passages all can be at least four times the size of the corresponding elements of conventional poppet valve engines. Not only does this greatly increase the pumping efficiency of the RVD, but also dramatically increases the air transport capacity of the engine as well. This increased transport capacity can be used to literally double the RPMs. The RVD can double the RPMs due to new developments in injector technology; conventional diesel engines have maximum RPM levels of 34000 RPMs; and the stroke of the RVD is short. The combination of these factors allow the doubling of RPMs without exceeding critical engine sliding speeds. In applications where high performance is more critical than engine life, the RVD has enough transport capacity to more than triple RPMs.

The RVD also increases engine thermal efficiency. Efficiency gains are possible because the large valve openings allow the power stroke to be lengthened, the valve of the RVD reduces heat losses because the same portions of the valve are always exposed to the same combustion cycle, and fins located in the exhaust valve transmit power back to the crankshaft. With increased RPMs and gains in both the thermal and pumping efficiencies, the RVD can reach unprecedented power to weight ratios in piston engine technology.

SUMMARY AND OBJECTS OF THE INVENTION

The present invention is an internal combustion engine having at least one cylinder. A rotary disk valve is located over the top of the cylinders for rotation about an axis parallel to the axis of the cylinders. The center of each cylinder is equally spaced from the axis of rotation of the rotary disk valve. The valve includes an intake passage for directing intake air into the cylinders and an exhaust passage for exhausting combustion gases from the cylinders. The intake passage and exhaust passage in the rotary valve communicate with each cylinder in succession as the valve rotates, allowing the use of a single valve to serve multiple cylinders. Seals disposed around each cylinder press against the bottom surface of the valve to prevent the escape of combustion gases from the cylinder. In a preferred embodiment of the invention, the pressure of the seals against the bottom surface of the rotary valve is varied during each cycle of the engine. The pressure is lowest during the intake stroke and highest during the power stroke.

In another aspect of the engine, the intake and exhaust valve openings, the intake and exhaust passages within the valve, and intake and exhaust passages outside the valve are increased in size by at least 40% over conventional poppet valve engines. It is necessary to increase all openings and passages if increases in pumping efficiency and transport capacity are to be achieved. Some previous rotary valve engines showed the capacity to increase the intake valve opening or the exhaust valve opening, but not both, and certainly not these as well as all the intake and exhaust passages. This rotary valve engine is the first to demonstrate this ability. Therefore, the RVD has a transport capacity four times poppet valve engines while reducing pumping losses 75%.

Another feature of the RVD shapes the intake and exhaust openings of the valve to minimize valve overlap while maximizing valve opening areas. This allows the engine to be kept very compact without compromising pumping efficiency.

The RVD also utilizes a thermal reactor located within the valve. The thermal reactor is located over the hot portions of the valve and is insulated to keep the reactor temperature as high as possible in efforts to reduce engine emissions. The most conservative design is demonstrated in which cooling passages under the thermal reactor keep the valve from overheating. The use of more heat resistant materials in this portion of the valve would enable the coding passages to be eliminated to further increase temperatures inside the thermal reactor.

Noise is controlled by insulation inside the thermal reactor, the shape of the passage through the reactor and insulation inside the valve housing. The large valve openings and passages also significantly reduce engine noise by dramatically reducing the velocity of the gas through the engine.

The RVD uses twin counter-rotating crankshafts in engine configurations of four cylinders and larger. In the four cylinder, this configuration requires that each crankshaft have two crankthrows which are adjacent and 180 degrees apart. Each crankshaft has gears attached to it which mesh together to synchronize the crankshafts and transfer power to the crankshaft with the flywheel attached to it. The crankshaft without the flywheel has a gear on it to drive the valve. This arrangement is very effective in reducing vibration with minimal counter-weighting.

The crankthrows of each crankshaft overlap. This is possible because the crankthrows of opposing crankshafts are 180 degrees out of phase. The use of this feature allows the cylinders to be placed closer together thereby making the engine more compact.

The RVD utilizes state of the art injector technology. Periodic multiple pulses of fuel are injected during the compression and power cycles to decrease peak cylinder pressures and emissions. Using multiple injections also increases the time interval available for combustion while increasing burn rates. This, combined with increased air transport capacity enables the RVD to dramatically increase RPMs. The fuel injectors are mounted perpendicular to the cylinder walls. Opposed wall wetting is avoided by the use of small diameter nozzles. Being adjacent to the injector, diesel fuel is deposited on the bottom surface of the valve and lubricates the seals. However, most of this liquid fuel covered surface moves to the next cylinder before the fuel is combusted reducing this surface as a source of emissions.

Based on the foregoing, it is a primary object of the present invention to provide a rotary valve engine which has both greater pumping efficiencies and air transport capacities as compared to poppet valve engines.

It is another object of the present invention to provide a rotary valve engine which has greater thermal efficiencies than poppet valve engines.

Another object of the present invention is to provide a rotary valve engine which will have lower emissions than poppet valve engines.

Still another object of the present invention is to provide a rotary valve engine which will exhibit lower noise, vibration and harshness than poppet valve -engines.

Yet another object of the present invention is to provide a rotary valve engine which is compact and lightweight.

Another object of the present invention is to provide a rotary valve engine which will increase RPMs compared to poppet valve engines.

Yet another object of the present invention is to provide a rotary valve engine which will increase the power to weight ratio.

Still another object of the present invention is to provide a rotary valve engine which will be relatively inexpensive to produce.

Other objects and advantages of the present invention will become apparent and obvious from a study of the following description and the accompanying drawings which are merely illustrative of such invention.

DETAILED DESCRIPTION OF THE INVENTION

Figure 1:
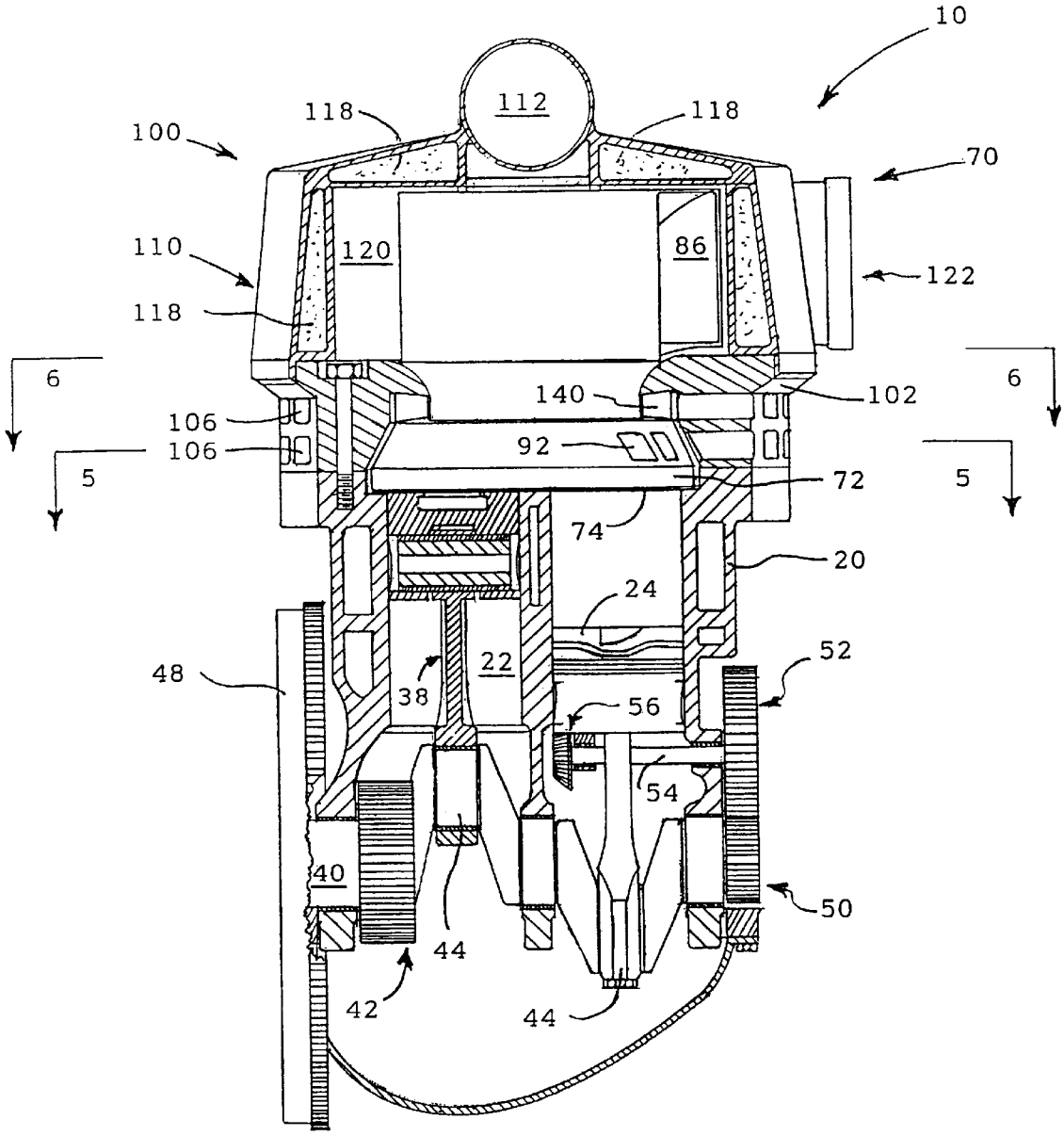
FIG. 1 is a longitudinal cross-section of the rotary valve engine through the centers of the two closest cylinders with the rotary valve in elevation view.
Figure 2:
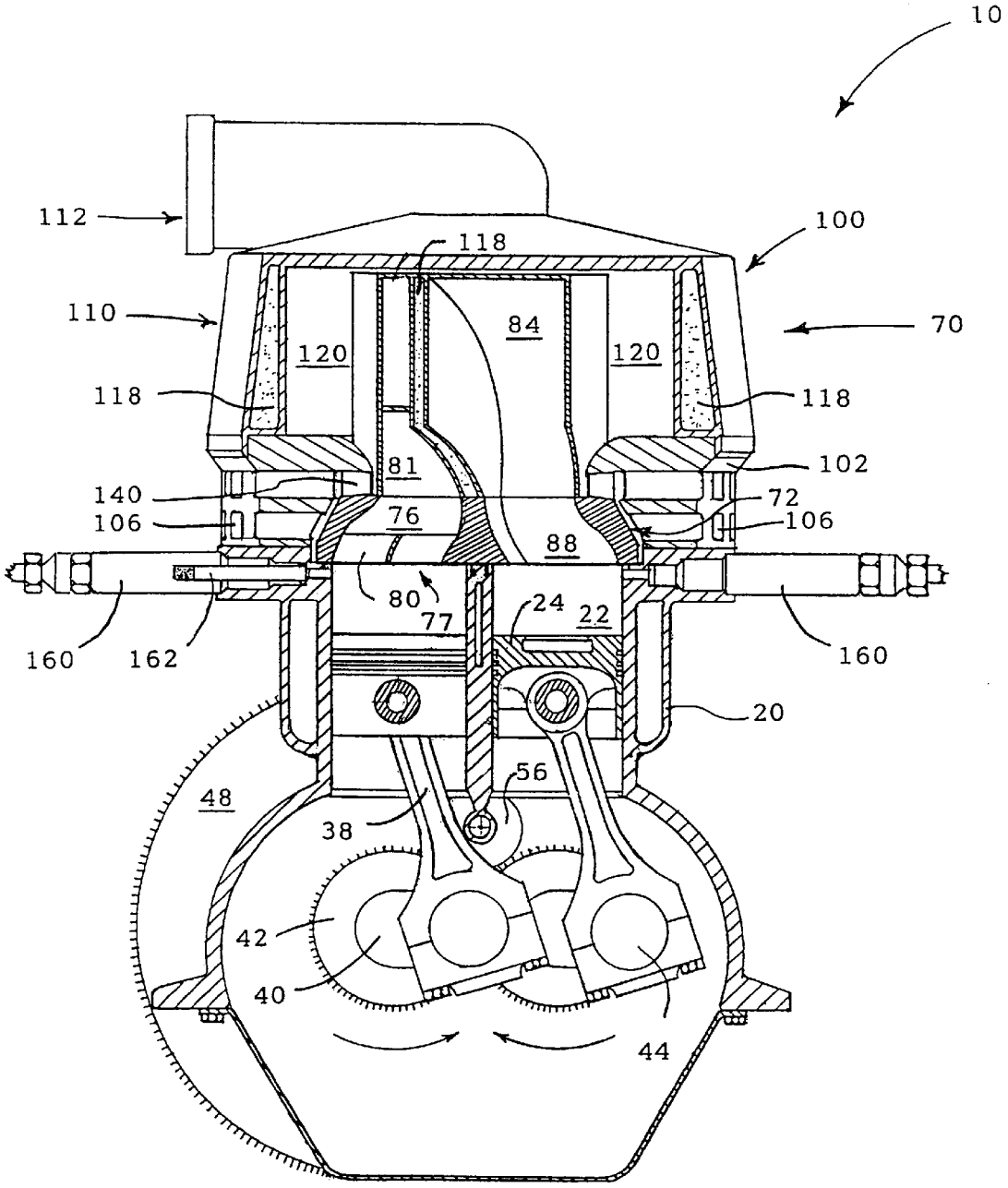
FIG. 2 is a cross-section of the rotary valve engine viewed parallel to the crankshafts and through the centers of the two closest cylinders.

Referring now to the drawings, the rotary valve engine of the present invention is shown therein and indicated generally by the numeral 1 0. The rotary valve engine 10 includes an engine block 20, having a plurality of cylinders 22 in which reciprocating pistons 24 are mounted. A rotary valve assembly 70 is disposed on the top of the engine block 20 for directing air into cylinders 22 and exhausting combustion gases. The rotary valve assembly 70 comprises a valve housing 100 secured to the engine block and a single, disc-type rotary valve 72.

The engine block 20 encloses cylinders 22 circumferentially spaced about the axis of rotation of the valve 72. The center of each cylinder 22 is equidistant from the rotation axis of the valve 72. A piston 24 is mounted for reciprocating movement within each cylinder 22. Each piston 24 is connected by a piston rod 38 to a rotating crankshaft 40. The disclosed embodiment has two, parallel crankshafts 40 each with a gears 42 which mesh with one another. Thus the crankshafts will rotate in opposite directions. Each crankshaft 40 includes two crank throws 44 to which respective piston rods 38 are connected. The crank throws 44 on each crankshaft 40 are disposed 180 degrees apart from one another. Thus, even though the circular path of travel of the crank throws 44 on opposite crankshafts 40 can overlap, the crank throws 44 avoid contact by being out-of-phase with one another. This allows the crankshafts 40 to be placed closer together. In addition, compared to an inline configuration, this twin crankshaft design decreases each crankshaft length by almost two thirds or the combined length by almost one third. Not only does this latter configuration produce a much more compact design, but one that is stiffer and of less mass as well.

Figure 4:
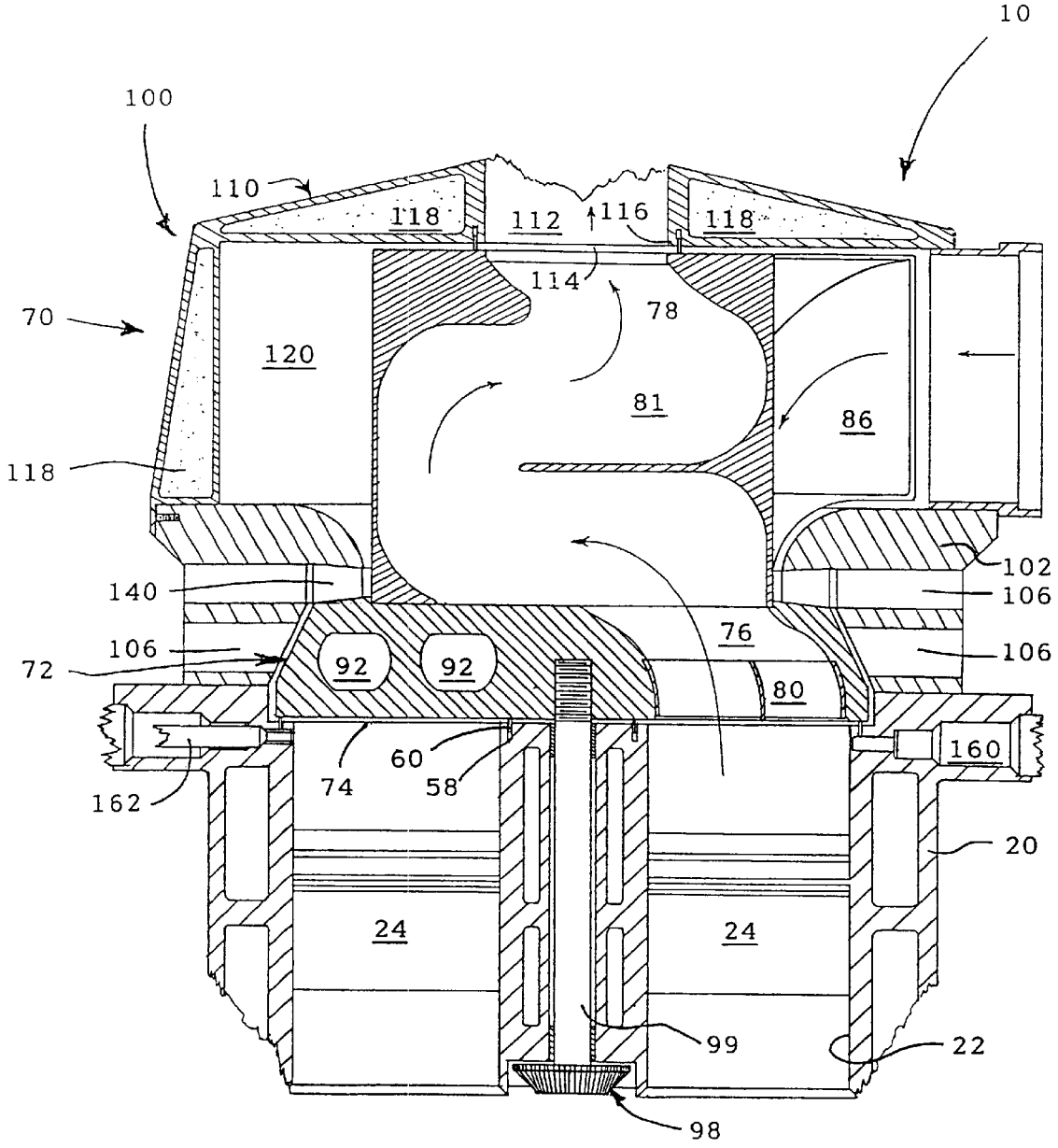
FIG. 4 is a cross-section view of the rotary valve engine diagonally through the center of the engine block; (Line 4—4 of FIG. 3)
Figure 5:
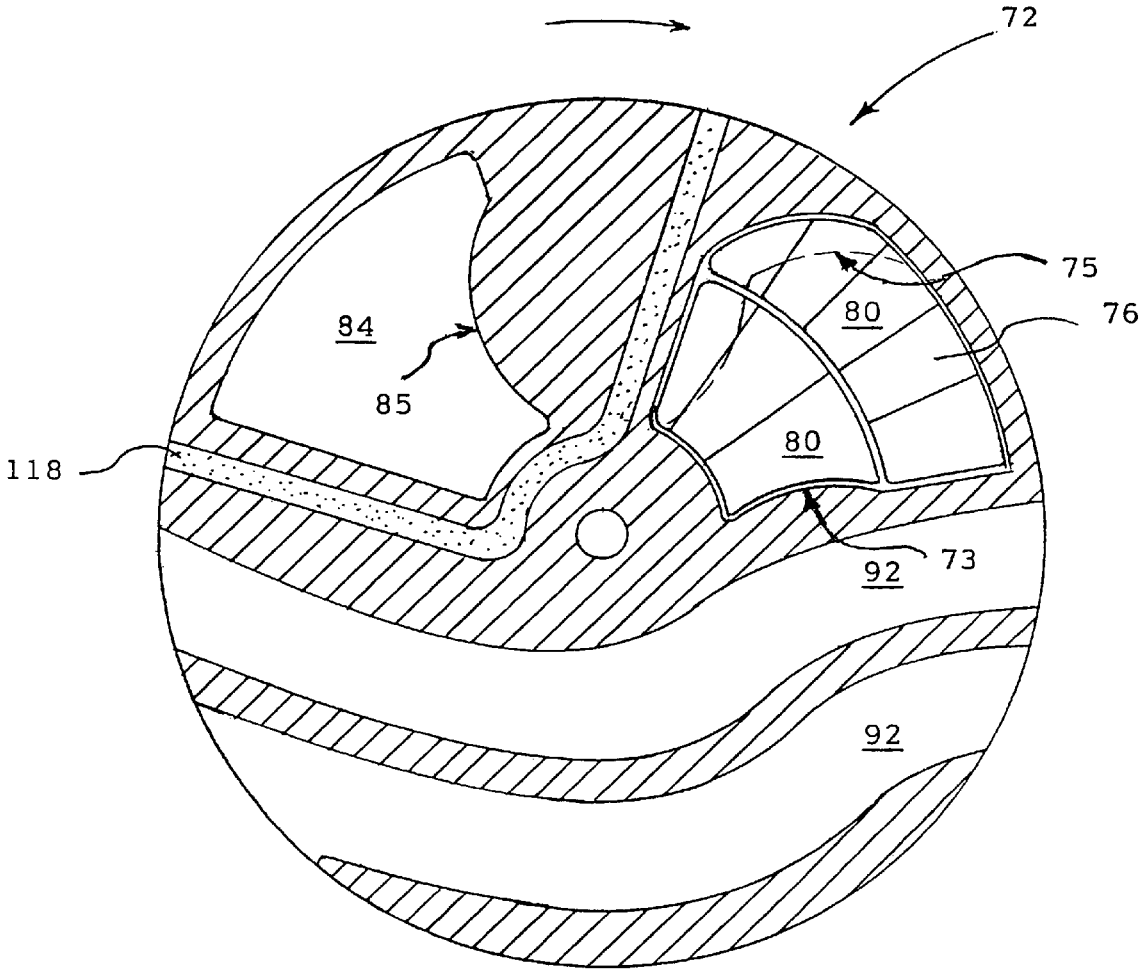
FIG. 5 is a cross-section view of the rotary valve taken through line 5—5 of FIG. 1.
Figure 6:
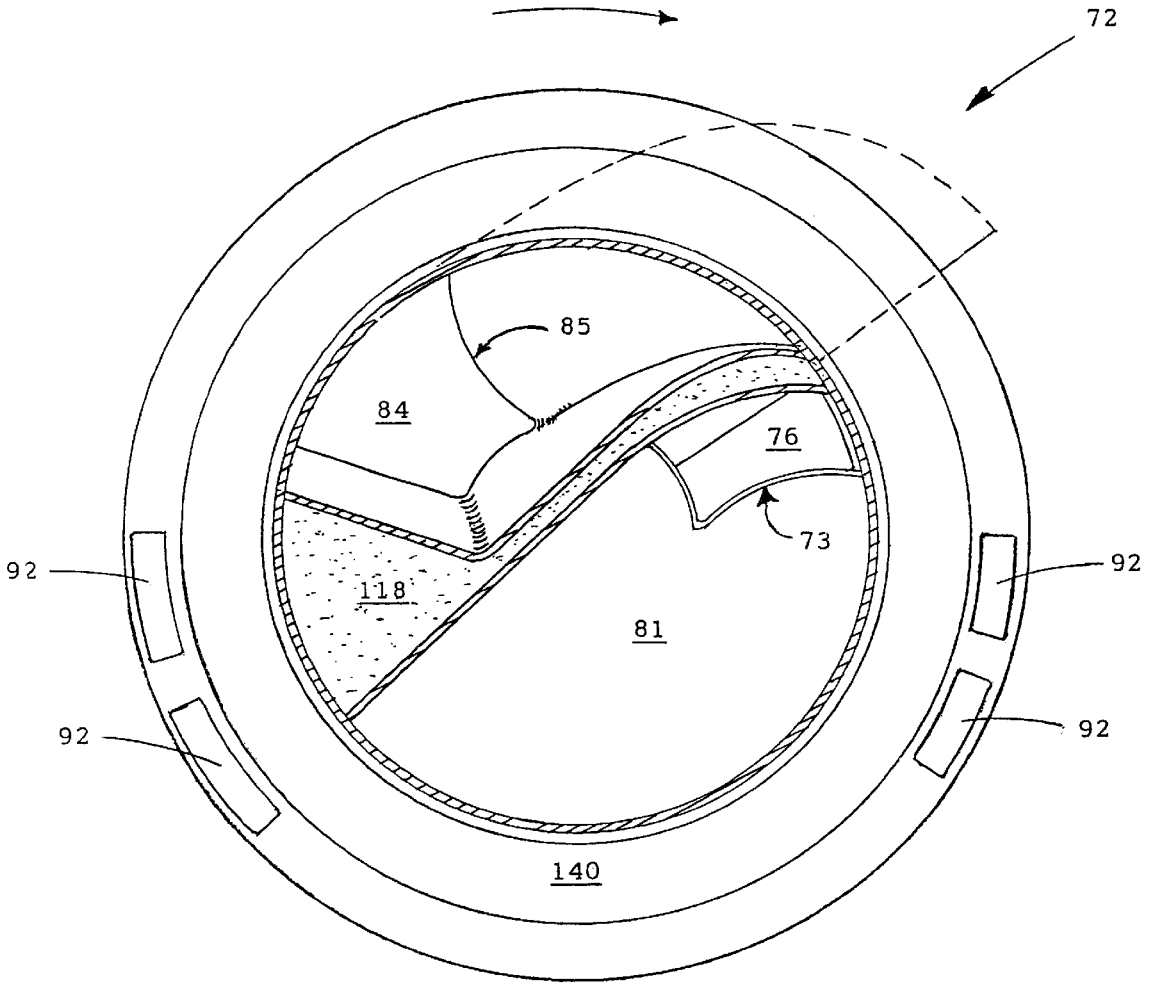
FIG. 6 is a cross-section view of the rotary valve taken through line 6—6 of FIG. 1.

On the end of one of crankshafts 40, is placed flywheel 48. On the opposite end of the other crankshaft, is spur gear 50, which turns spur gear 52, and shaft 54 located above crankshaft 40 but midway between them. At the end of shaft 54 is bevel gear 56 which meshes with bevel gear 98 (FIG. 4) attached to shaft 99 which drives rotary valve 72 at one half the crankshaft speed. Crankshafts 40 with adjacent crank throws 180 degrees apart are better balanced with respect to first and second degree harmonics than is the conventional inline four cylinder crankshaft. Further, since the RVD uses counter revolving crankshafts 40 geared to each other, any inbalances tend to be cancelled out. Additionally, since there are no reciprocating valves to produce vibrations, but a rotating valve mass which tends to counter residual vibrations from the crankshafts 40, the RVD should exhibit much lower levels of vibration.

The rotary valve assembly 70, is mounted on top of the engine block 20. The valve assembly 70 includes a single disc-type valve 72 which is mounted for rotation on the engine block 20, and a valve housing 100 which encloses the valve 72. The rotary valve 72 has a flat bottom surface 74 and is large enough to cover all four cylinders 22. The valve 72 includes an exhaust passage 76 and an intake passage 84. The exhaust passage 76 includes an inlet 77 on the bottom 74 of the valve 72 and an outlet 78 at the top of the valve 72 along the axis of rotation of the valve 72. The inlet 77 of the exhaust passage 76 is positioned such that it communicates with each cylinder 22 in succession as the valve 72 rotates. Compounding fins 80 extend across inlet 77 of the exhaust passage 76. The function of the compounding fins 80 will be described below.

The intake passage 84 includes an inlet 86 disposed on the outer circumference of the valve 72 adjacent to the top surface and an outlet 88 on the bottom 74 of the valve 72. The inlet 86 faces the direction of rotation of the valve 72 so that it functions somewhat like an air scoop as the valve 72 rotates, creating pressure that forces air down through the intake passage 84 into the cylinders 22.

Figure 3:
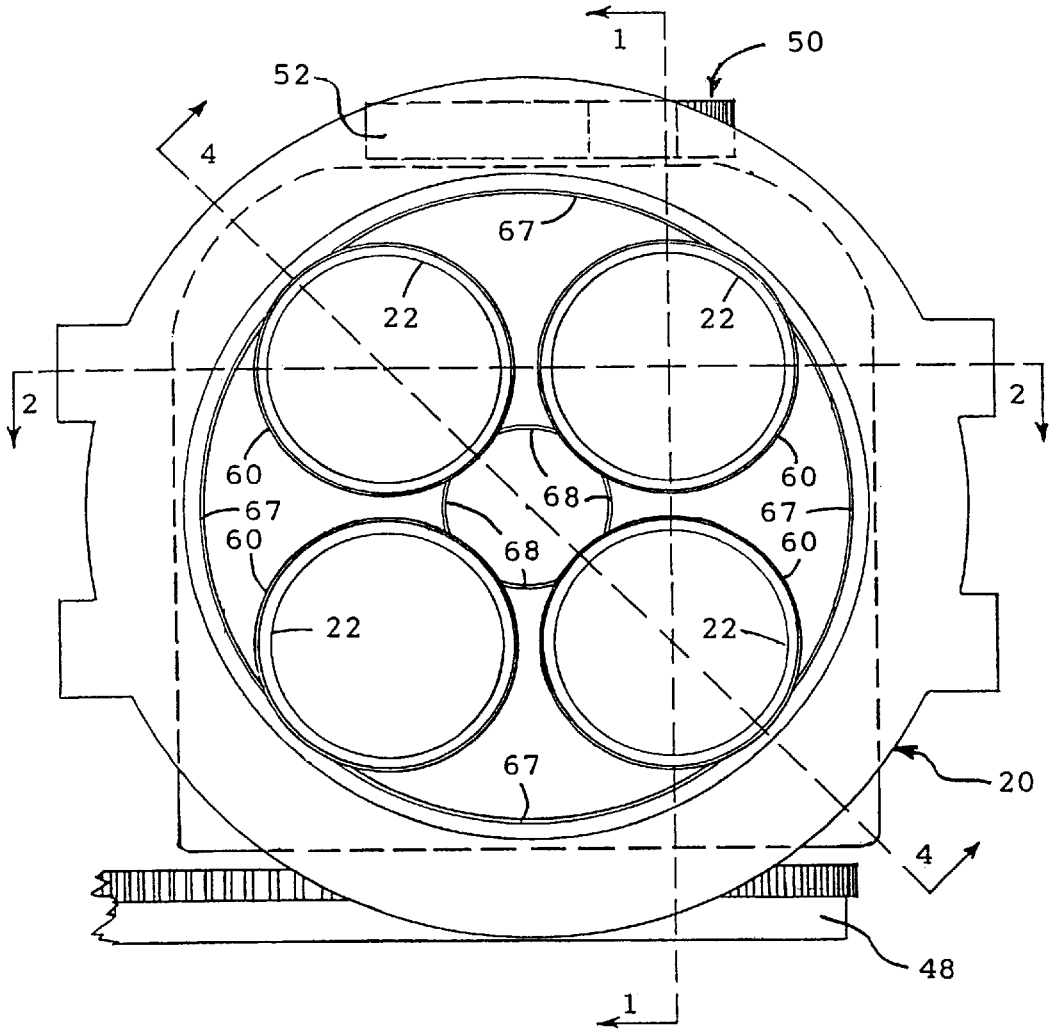
FIG. 3 is a top plan view of the engine block.

Of critical importance is the seal system depicted in FIG. 3. Most rotary valve engines are unsuccessful due to their inability to adequately seal the combustion chamber without excessive friction or excessive oil consumption. This problem is overcome by the cylinder seals 60. The cylinder seals 60 fit into circular grooves 58 surrounding each cylinder 22. Seals 67 and 68 are mounted in a similar manner to seals 60, and are used to prevent the escape of exhaust gas through the cooling vents, 106. Since seals 67 and 68 do not need to control high pressure gas, the pressure of these seals against the bottom surface 74 of the valve 72 is greatly reduced. The seal system shown in FIG. 3 is superior for several reasons. First, a single "O" ring seals the entire combustion chamber providing a stronger seal without gaps. Second, since the seals are made of ceramics or are ceramic coated and using diesel fuel lubricates the seals, friction and wear is reduced without the introduction of emission increasing lubrication oil.

Valve 72 is enclosed by the valve housing 100. The valve housing 100 includes a ring structure 102 and a manifold 110. The ring structure 102 defines part of the intake cavity and supports the upper portions of the engine. Bearing 140 restrains the valve 72 from vertical movement while allowing the valve 72 to rotate freely about its axis. Air vents 106 are circumferentially spaced around the ring structure 102. Air is drawn through vents 106 by the rotating valve 72. Air passes through a cooling passage 92 in the valve 72 cooling the interior of the valve 72. Preferably valve 72 would be insulated by ceramics on the bottom surface 74, to both reduce heat transfer to the valve and increase wear resistance of the bottom 74 of valve 72. Insulation 118, is placed at various places in the valve 72 and housing 110 to reduce heat transfer to other portions of valve 72 and housing 110.

The manifold 110 is mounted on top of the ring structure 102. The manifold 110 includes an exhaust pipe 112. A seal 114 fits in a groove in the flanged end 116 to prevent the escape of exhaust gases. Exhaust passage 76 is insulated internally by ceramics or externally with appropriate material to prevent heating the intake air. Thermal reaction chamber 81 is located immediately after the exhaust passes through compounding fins 80 and is actually part of the valve exhaust passage 76. Situated on top of the hot portions of the valve 72 and insulated from the cooler portions, thermal reaction chamber 81 keeps the exhaust temperatures elevated for longer periods of time allowing further oxidation of the exhaust gas thereby reducing emissions. The manifold 110 also includes an annular cavity 120 used to supply air to intake 84. Intake opening 122 receives air from the supercharger (not shown) and transports the air into the annular cavity 120.

The intake and exhaust openings are shaped to maximize the valve opening area and to minimize the valve overlap. As in most disc valve openings, the valve openings initially were described by drawing two circles which would fall just within the inside and outside limits of the innermost and outermost seals. Straight lines connect the two circles and the space between these two lines (for each of the intake and exhaust openings) determine the valve opening duration. This geometric arrangement presents certain limitations in rotary valve engine design. First, with respect to the valve rotation, the leading straight line of the valve opening uncovers circular ports or cylinders. Since the flow rate from the ports or cylinders is determined by the area uncovered by the rotating valve openings, the opening and closing flow rate of most rotary valve engines is inferior to poppet valve engines. This is due to the leading and trailing straight line edges of the rotary valve design uncovering (when opening) or covering (when closing) less area of the circular ports or cylinders as compared to the vertical opening of the entire port in poppet valve engines. The RVD overcomes this problem by better matching the geometric size and shape of the valve openings to the seals around the port or cylinder openings. Where desired, the RVD matches the leading and trailing edges of the intake and exhaust openings to the port or cylinder openings. This dramatically increases both the opening and closing flow rates of the intake and exhaust valves.

Another problem related to opening and closing valve rates is valve overlap. This problem can be especially acute in rotary valve engines in which a single rotary valve serves multiple cylinders because if the valve overlap is too large, three cylinders (in the case of a four cylinder engine) can be open to the intake and exhaust valve openings at the same time. In the RVD, the leading edge 85 of the intake, the leading edge 73 of the exhaust, and the trailing edge 75 of the exhaust, portions of these edges contain geometric shapes similar to those of the seals around the cylinders uncovered. Since this increases the opening and closing rates of the valve, the space between the intake and exhaust openings can be increased without increasing the distance between the cylinders. This reduces valve overlap and avoids the uncovering of too many cylinders at one time. Also, since the distance between the cylinders can be less, the overall size of the engine block is reduced allowing the size and weight of the engine to be reduced.

Fuel injectors 160 can be mounted conventionally near the top of the engine block 20 to access each cylinder 22, or directly on rotary valve 72 and supply fuel to each cylinder. In the preferred cylinder location, a small proportion of fuel is "pilot injected" before the piston 24 reaches top dead center to reduce NOx emmissions. The remainder of the fuel is injected near top dead center initiating combustion and the expansion of gases driving piston 24 downward. Piston 24 is notched where it passes injector 160 allowing the fuel to be injected near top dead center. Alternatively, fuel can again be pilot injected, but earlier in the combustion cycle, and a second time just before reaching top dead center, but before the piston 24 covers the fuel injector 160, with enough fuel to initiate visible combustion, and a third time just after the piston 24 clears injector 160. This would allow the combustion bowl in the piston 24 to remain intact reducing crevice space volume. Cylinder wall wetting is avoided because with current technology, (high pressure common rail injectors) small holes in the fuel injector nozzles prevent liquid fuel being deposited on the opposite surface. Further, less liquid fuel is deposited in the bowl as compared to conventional head locations, resulting in less smoot production. Glow plug 162 is used to aid in starting rotary valve engine 10.

In operation, intake air enters the annular chamber of the valve housing 100 from the supercharger or other intake source. As the valve 72 rotates, the intake air enters the inlet 86, passes through intake passage 84, and enters one of the cylinders 22 of the engine block while the piston 24 is moving downward. The downward motion of the piston 24 within cylinder 22 creates a partial vacuum within the cylinder 22 that pulls the intake air into the cylinder 22. Pressure within intake 84 is increased by the air scoop effect and the decelerating air column caused by the closing of outlet opening 88. This increased pressure allows the outlet opening 88 to close after piston 24 starts upward, creating higher charge pressures in cylinder 22. Further, this effect is maintained as rpm's increase, since pressure from the scoop effect increases with increasing rpm's offsetting increasing drag created by increasing air velocities. The bottom 74 of the valve 72 rotates over the cylinder 22 to effectively close the valve 72.

The compression stroke begins with the piston 24 moving upward within cylinder 22 with the flat bottom 74 of the valve 72 overlying the cylinder 22. The upward motion of the piston 24 compresses the air within the cylinder 22. A pilot fuel charge is injected during the compression stroke by injectors 161 to reduce peak combustion pressures and NOx emissions. The injection of the fuel into the cylinders 22 slightly moderates heat and pressure created by the rising piston 24 during compression. The main fuel charge can be injected before top dead center and stopped before piston 24 blocks the side injector 160 and again injects fuel after piston 24 passes the injector on the power stroke. As the piston 24 reaches top dead center, the main charge of fuel is injected to complete the combustion sequence within the cylinder 22.

Intake turbulence caused by the valve 72 moving over the top of the cylinder 22 during intake and maintained by the rotating surface of the valve 72 above during compression, and the piston chamber design, promote complete combustion of the fuel. The heat of combustion causes forceful expansion of gases that push the piston 24 downward. The downward force is carried through the piston rods 38 to the crankshaft 40 which is given a powerful turn. As the piston 24 reaches the bottom of its power stroke, the exhaust passage 76 rotates over the cylinder 22. The exhaust stroke begins with the upward movement of the piston 24 which forces the combustion gases through the exhaust passage 76 and out the exhaust pipe 112. The compounding fins 80 in the exhaust passage 76 are designed to take advantage of the residual energy of the exhausted gases. The exhaust gases exit between the compounding fins 80 which are mounted at an angle to drive the valve 72. The exhaust gases then pass into the thermal reator 81. Since valve 72 serves all four cylinders; is heated by the hottest portions of valve 72, and is insulated from the cooler portions, the chamber 81 remains very hot. The passage 76 is extended by forcing the gas to follow the longest possible route through thermal reator 81 to the exhaust pipe 112. While the exhaust gas resides in thermal chamber 81, it is further oxidized resulting in fewer emissions. Reaction chamber 81 also aids in reducing engine noise as it is insulated and the indirect passage reduces the amplitude of the sound waves. After thermal chamber 81, the exhaust passes through exhaust pipe 112, and into a catalytic converter to further reduce emissions. (not shown).

Figure 7:
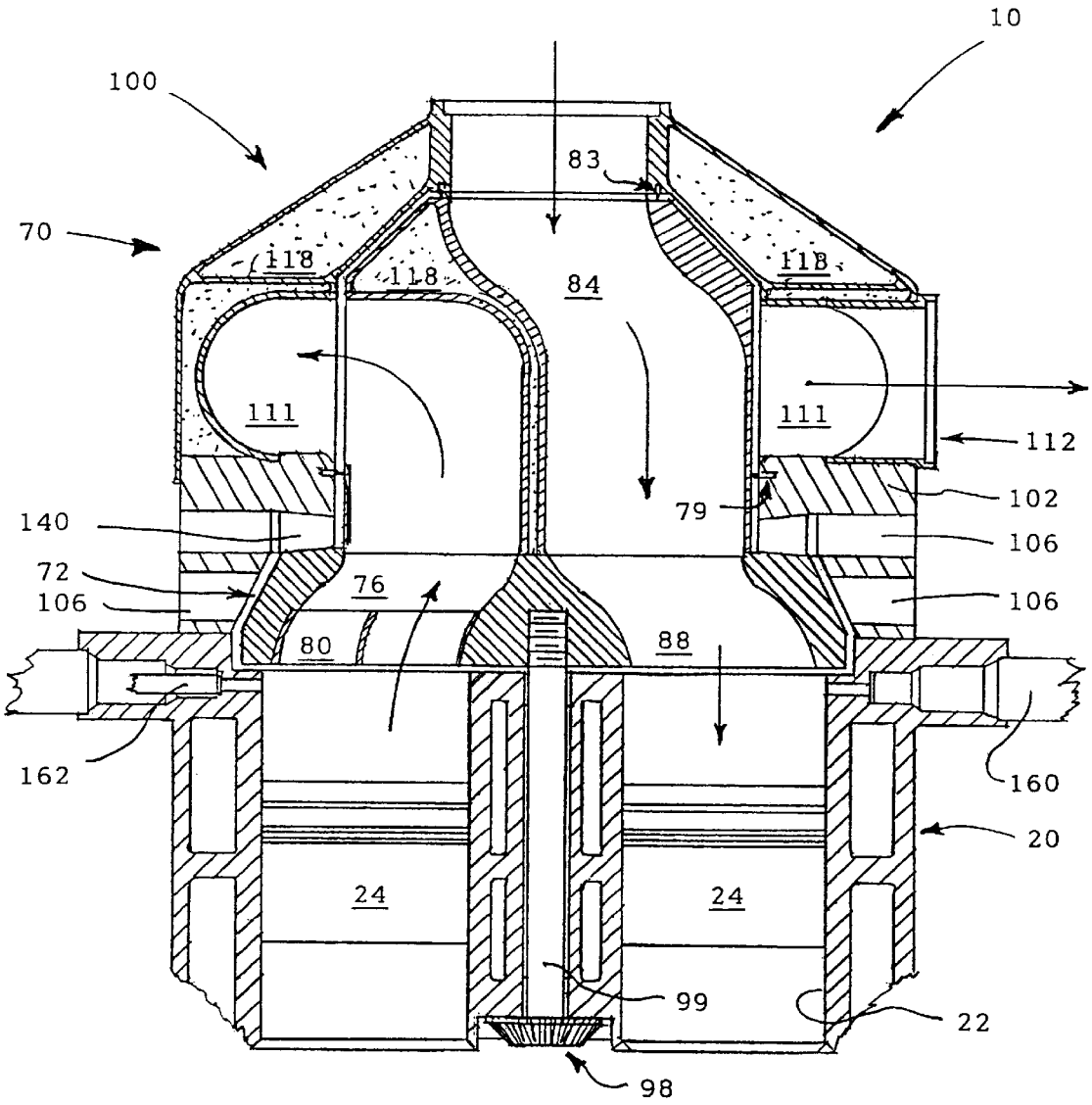
FIG. 7 is a cross-section view of the centrally located intake engine diagonally through the center of the engine block.

FIG. 7 shows a related version of the rotary valve diesel in which the primary change is the switching of positions of the intake and exhaust in the valve and engine. Now intake passage 84 originates at the top of the engine to enter cylinder 22 through intake outlet 88. Exhaust passage 76, located in valve 72, exits into the exhaust manifold 111 which surrounds valve 72 transporting the exhaust gas to exit the engine through exhaust pipe 112. Intake seal 83 prevents the escape of intake air while seal 79 is added to prevent the passage of exhaust gas to the bearing 140. Block 20 and the rest of the engine 10 below valve 72 remains unchanged.

Comparing each version to the other, the central intake engine has several disadvantages. Obviously, the central intake version lacks the air scoop, but it also requires an extra seal to prevent the escape of exhaust gas and also allows greater heating of antifriction bearings 140. However, the central intake version is slightly more compact and can be more easily used with port fuel injection. Therefore, with the exception of the differences noted, both versions share many advantages.

Perhaps the most significant advantage of the rotary valve is its ability to efficiently transport large volumes of air. Conventional poppet valve engines typically have effective intake to bore areas of about 25% with the best engines achieving about 30%. However, as the cylinder displacement is reduced, the maximum ratio decreases due to the inability to proportionally reduce components such as valve stem, fuel injector and glow plug diameters, all of which are located in the head of conventional poppet valve engines. This is the main reason the recently introduced Volkswagen 1.9 liter diesel has a intake to bore area of 21%. Since the RVD has none of these elements in the head during the intake or exhaust cycles, and because the RVD valve is unaffected by scale, the rotary valve engine intake and exhaust valve opening areas greatly exceed poppet valve areas. For example, a rotary valve engine less than half the displacement of the Volkswagen 1.9 liter has a intake to bore area of 95%, or a ratio of 4.5 times the Volkswagen. Since the intake and exhaust valve openings, and all intake and exhaust passages are designed to duplicate this value, the rotary valve engine dramatically increases pumping efficiency and air transport capacity.

Another significant advantage is the greatly improved thermodynamic cycle. With a single rotary valve serving multiple cylinders, the hot areas of the valve stay hot, while the cool areas remain cool. This effect can be intensified by placing thermal breaks, where possible, to prevent the heat transfer through the valve. Further, since there is no lubricating required in the valve itself, operational temperatures of the valve and engine can be increased. In addition, the rotary valve, having dramatically increased exhaust openings, can lengthen the power stroke by delaying the exhausting of the charge, thereby utilizing more of the available heat energy. Finally, the rotary valve incorporates compounding fins in the valve to drive the valve and directs any additional energy back to the crankshaft. The sum of all these elements significantly increases the thermal efficiency of the rotary valve engine.

The rotary valve engine also has the major advantage of reduced vibration. Principally, this is due to the use of a twin, counter-rotating crankshaft system which tends to cancel out unbalances from the opposing crankshaft. This system is enhanced by using crankshafts with adjacent crank throws 180 degrees apart resulting in superior balancing compared to in-line four cylinders. Further, a relatively easily balanced rotary valve whose rotating mass dampens any residual crankshaft vibration, replaces vibration prone reciprocating valves.

The rotary valve diesel should be the most efficient piston engine available. With increased pumping and thermal efficiencies, more output from the same amount of fuel is obtained. Further, with these efficiencies, and the increased pumping capacity, the rotary valve diesel can achieve rpm levels two or three times conventional poppet valve engines. This allows the engine displacement to be reduced while still providing the same output of substantially larger displacements, resulting in an engine with a greatly increased power to weight ratio.

Reduced displacement leads to the next advantage of being compact and lightweight. Also contributing to the compactness, is the use of twin crankshafts, the use of overlapping crank throws, and a single valve rotary valve serving multiple cylinders.

Yet another advantage of the rotary valve engine is its' reduced emissions. Being more compact and efficient, the rotary valve diesel burns less fuel and produces fewer emissions.

Additionally, lower combustion peak pressures, hotter exhaust, and utilization of a thermal reactor all serve to further reduce emissions.

Finally, the rotary valve diesel possess the advantage of being very price competitive with conventional poppet valve diesels. This price competitiveness is due to the simplicity of the rotary valve diesel valve system which contains fewer parts, and its' ease of assembly and manufacture.

Finally, since the intake valve openings and passages are much larger than poppet valve engines, there is less heating of the intake air. Due to this, it may be possible to avoid using an intercooler which would reduce the cost of the rotary valve engine.

In summary, the rotary valve diesel engine is the most efficient internal combustion engine yet designed. Due to the rotary valves' large transport capabilities, it is especially suited to high compression engine use which require increased volumes of air. Therefore, in a diesel application, it can transport enough air to achieve rpm levels two or three times that of conventional poppet valve engines, producing a piston engine with an unprecedented power to weight ratio. Further, since the transport capacity of the rotary valve engine is unaffected by reduced scale, it is very attractive for use in small engine applications.

Based on the foregoing it is apparent the rotary valve engine of the present invention has numerous advantages over conventional poppet valve engines. First the rotary valve engine dramatically increases pumping efficiencies and air transport capacities. Second, thermal efficiencies are also improved. Third, noise, vibration and harshness are significantly reduced. Forth, increased efficiency increases both fuel economy and decreases emissions. Fifth, the engine is more compact and lightweight. Finally, the rotary valve engine is very price competitive with existing poppet valve technology.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A rotary valve engine comprising:

(a) an engine block having at least one cylinder;

(b) a reciprocating piston mounted in said cylinder;

(c) a crankshaft rotatably mounted to said engine block;

(d) a connecting rod connecting each said piston to said crankshaft to rotate said crankshaft as said pistons reciprocate in said cylinders;

(e) a disc-type rotary valve mounted on said engine block;

(f) an intake passage formed in said rotary valve for directing intake air into each said cylinder in succession as said valve rotates, said intake passage having a cross-sectional area at its narrowest point of at least 40% of the cross-sectional area of said cylinders;

(g) an exhaust passage formed in said rotary valve for exhausting combustion gases from said cylinders in succession as said valve rotates, said exhaust passage having a cross-sectional area at its narrowest point of at least 40% of the cross-sectional area of said cylinders;

(h) a means to supply intake air to said rotating valve, said intake means having a cross-sectional area at its narrowest point of at least 40% of the cross-sectional area of said cylinders;

(i) a means to transport exhaust gas from said rotating valve, said exhaust means having a cross-sectional area at its narrowest point of at least 40% of the cross-sectional area of said cylinders;

(j) means for mixing fuel with said intake air; and (k) ignition means for igniting said fuel/air mixture in said cylinders.

2. A rotary valve engine comprising:

(a) an engine block having a combustion chamber;

(b) a drive member mounted on said combustion chamber;

(c) a crank shaft rotatably mounted to said engine block and driven by said drive member;

(d) a disc-type rotary valve mounted on said engine block;

(e) an intake passage formed in said rotary valve for directing air into said combustion chamber as the rotary valve rotates;

(f) an exhaust passage formed in said rotary valve for exhausting combustion gases from said combustion chamber as said rotary valve rotates; and (g) wherein said intake passage and said exhaust passage are spaced at the same radius from the axis of rotation of said rotary valve;

(h) said exhaust passage including an outlet opening aligned with the axis of rotation of said rotary valve.

3. A rotary valve engine comprising:

(a) an engine block having a combustion chamber;

(b) a drive member mounted on said combustion chamber;

(c) a crank shaft rotatably mounted to said engine block and driven by said drive member;

(d) a disc-type rotary valve mounted on said engine block;

(e) an intake passage formed in said rotary valve for directing air into said combustion chamber as the rotary valve rotates;

(f) an exhaust passage formed in said rotary valve for exhausting combustion gases from said combustion chamber as said rotary valve rotates; and (g) wherein said intake passage and said exhaust passage are spaced at the same radius from the axis of rotation of said rotary valve;

(h) said intake passage including an inlet opening aligned with the axis of rotation of said rotary valve.

4. A rotary valve engine comprising:

(a) an engine block having a combustion chamber;

(b) a drive member mounted on said combustion chamber;

(c) a crank shaft rotatably mounted to said engine block and driven by said drive member;

(d) a disc-type rotary valve mounted on said engine block;

(e) an intake passage formed in said rotary valve for directing air into said combustion chamber as the rotary valve rotates;

(f) an exhaust passage formed in said rotary valve for exhausting combustion gases from said combustion chamber as said rotary valve rotates; and (g) wherein said intake passage and said exhaust passage are spaced at the same radius from the axis of rotation of said rotary valve;

(h) said exhaust passage including a reaction chamber to reduce engine emissions.

5. A rotary valve engine comprising:

(a) an engine block having a plurality of cylinders;

(b) a reciprocating piston mounted in each cylinder;

(c) twin crankshafts rotatably mounted to said engine block;

(d) a connecting rod connecting each said piston to said crankshaft to rotate said crankshaft as the pistons reciprocate in said cylinders;

(e) a disc-type rotary valve mounted on said engine block above;

(f) an intake passage formed in said rotary valve for directing intake air into each said cylinder in succession as said valve rotates, (g) an exhaust passage formed in said rotary valve for exhausting combustion gases from said cylinders in succession as said valve rotates;

(h) wherein said intake passage and said exhaust passage are spaced at the same radius from the axis of rotation of said rotary valve;

(i) means for mixing fuel with said intake air; and (j) ignition means for igniting said fuel/air mixture in said cylinders.

6. The rotary engine of claim 5 wherein said crankshafts have crank throws describing overlapping paths with each other.

7. A rotary valve engine comprising:

(a) an engine block having a combustion chamber;

(b) a drive member mounted on said combustion chamber;

(c) a crank shaft rotatably mounted to said engine block and driven by said drive member;

(d) a disc-type rotary valve mounted on said engine block;

(e) an intake passage formed in said rotary valve for directing air into said combustion chamber as the rotary valve rotates;

(f) an exhaust passage formed in said rotary valve for exhausting combustion gases from said combustion chamber as said rotary valve rotates; and (g) means to prevent the escape of combustion gases from said combustion chamber, said means being a seal;

(h) an intake opening in said intake passage which communicates with each combustion chamber as said rotary disc valve rotates; whereas said intake opening has as part of its geometric shape a leading edge containing the same geometric shape as said seals;

(i) an exhaust opening in said exhaust passage which communicates with each combustion chamber as said rotary disc valve rotates; whereas said exhaust opening has as part of its geometric shape a leading edge containing the same geometric shape as said seals;

(j) an exhaust opening in said exhaust passage which communicates with each combustion chamber as said rotary disc valve rotates; whereas said exhaust opening has as part of its geometric shape a trailing edge containing the same geometric shape as said seals;

(k) means for mixing fuel with said intake air; and (l) ignition means for igniting said fuel/air mixture in said cylinders.

* * * * *